US011337015B2

(12) United States Patent
Christensen et al.

(10) Patent No.: US 11,337,015 B2
(45) Date of Patent: May 17, 2022

(54) CLOSING ASSEMBLY FOR AN IN THE EAR PART OF A HEARING DEVICE

(71) Applicant: Oticon A/S, Smørum (DK)

(72) Inventors: Lars Steen Christensen, Smørum (DK); Kristoffer Runge, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 17/097,438

(22) Filed: Nov. 13, 2020

(65) Prior Publication Data

US 2021/0152961 A1 May 20, 2021

(30) Foreign Application Priority Data

Nov. 15, 2019 (EP) ..... 19209493

(51) Int. Cl.
*H04R 25/00* (2006.01)
*H04R 1/10* (2006.01)

(52) U.S. Cl.
CPC ..... *H04R 25/652* (2013.01); *H04R 1/1066* (2013.01); *H04R 25/604* (2013.01); *H04R 2225/0213* (2019.05); *H04R 2225/77* (2013.01)

(58) Field of Classification Search
CPC .. H04R 25/556; H04R 13/2471; H04R 25/60; H04R 2225/021; H04R 2225/0213
See application file for complete search history.

(56) References Cited

U.S. PATENT DOCUMENTS

2007/0183612 A1* 8/2007 Ochsenbein ..... H04R 25/60 381/322

FOREIGN PATENT DOCUMENTS

| | | | |
|---|---|---|---|
| EP | 1 816 893 | A1 | 8/2007 |
| EP | 2 001 263 | A2 | 12/2008 |
| EP | 2 001 263 | A3 | 1/2009 |
| WO | WO 2013/123992 | A1 | 8/2013 |

* cited by examiner

*Primary Examiner* — Amir H Etesam
(74) *Attorney, Agent, or Firm* — Birch, Stewart, Kolasch & Birch, LLP

(57) ABSTRACT

The present disclosure relates to an in-the-ear part having a closing assembly. The in-the-ear part configured to be attached to a hearing device. The in-the-ear part having a cavity for holding an output transducer and the in-the-ear part having an opening and the closing assembly being configured to fit into the opening. An insert part having an inset part opening for receiving and mounting a connecting member is also mounted to the in-the-ear part, the connecting member configured for mechanically coupling the in the ear part to a behind the ear part of the hearing device. A cover part is further provided, which comprises a recess for receiving and mounting the insert part to the in-the-ear part.

24 Claims, 4 Drawing Sheets

CLOSING ASSEMBLY FOR AN IN THE EAR PART OF A HEARING DEVICE

FIELD OF THE INVENTION

The present disclosure relates to a closing assembly for an in the ear part of a hearing device. Further, the present disclosure relates to a hearing aid comprising an in-the-ear part with the closing assembly, in particular to a behind the ear hearing aid (BTE).

BACKGROUND

In the field of hearing aid, especially BTE hearing aids, an issue of visibility of the hearing aid is important. In particular, users want a hearing aid to be visible as little as possible. In order to do that, one measure is to provide an in the ear part of a hearing device which has color adjusted to skin color. This could be achieved by an in the ear part of a hearing device to be provided in a customized color. However, a hearing aid has to be primarily suitable for hearing needs of the user. This means that a user needs to have a hearing device having specific gain for compensating a specific hearing loos of that user, which results in a specific size of the speaker/output transducer and subsequent size of a cover adjusted to the speaker. However, in such a case producing a hearing aid with an in-the-ear part being customized for the specific user requires not only a specific color but also specific size of the cover with connectors for connecting with an behind-the-ear part of the hearing aid. This results in increasing costs.

Therefore, there is a need to provide a solution that addresses at least some of the above-mentioned problems.

SUMMARY

According to an aspect of the disclosure a closing assembly for an in the ear part of a hearing device is provided. The closing assembly comprises the in-the-ear part having a cavity for holding an output transducer, the in-the-ear part having an opening and the closing assembly being configured to fit into the opening, the closing assembly comprising:

an insert part having an inset part opening for receiving and mounting a connecting member, the connecting member configured for mechanically coupling the in the ear part to a behind the ear part of the hearing device, and a cover part comprising a recess for receiving and mounting the insert part.

The insert part is a part which interconnects the cover with a connecting member in a fixed relationship. The insert can be produced in a single size and with covers of varying size, the combined cover and insert are able to provide an assembly supporting a large variety of output transducer sizes in a simple and efficient manner. Therefore, the insert can be used with different covers, for example with covers of different size. This makes the insert a universal part which may be used with many sizes of output transducers. This is because the size of the cover needs to be big enough to allow to place a speaker inside the in the ear part of the hearing device, like for example custom mold. Therefore, it this sense, the size of the cover needs to be adjusted to size of the speaker which is arranged in the ear part of a hearing device as the speaker/output transducer need to be inserted into the in-the-ear part during production, and as a larger speaker needs to be inserted, the corresponding opening in the in-the-ear part needs to be larger as well. This is especially important in customized in-the-ear parts, because in such products not only shape is adjusted to specific user, but also a color. Therefore, the cover may be produced in a customized color chosen to best match the skin color of the intended user, shape and size and then assembled with the insert part. Thus, in production, advantageously a lesser number of assembly variants is needed.

The closing assembly may comprise the insert part opening configured so that the connecting member enters to the insert part at an acute angle defined between the axis of an end part of a connecting member and a surface of the cover part.

The insert part has an opening configured to receive an end part of the connecting member. The end part of the connecting member may be fixed in the insert, e.g. mechanically such as by press fitting or the like, or by using an adhesive such as a glue. Thus, the insert part may be seen as a mounting element for the connecting member to the cover part. The end part of the connecting member is fixed to the insert part. When the end part is fixed in the opening of the insert, the end part, i.e. part of the connecting member, is arranged at an angle, such than when the insert is inserted to the cover, an elongated part of the connecting member is inclined towards surface of the cover. Between the axis of the end part of the connecting member and a surface of the cover an angle is defined, this angle is preferably less than 90 degrees. This allow the connecting member to be positioned closer to the head of the user when the user has the in-the-ear part mounted at least partially in the ear canal and a behind-the-ear part positioned in the area behind/at the top of the pinna. Advantageously, the elongated part is placed in the insert so that the elongated part is directed in direction where a behind the ear part of the hearing aid is placed.

The closing assembly may comprise the cover part which is configured for the in the ear part which is a mold shaped to an individual ear canal of the user.

The closing assembly may comprise the cover part configured so that it at least partially surrounds the insert part.

The closing assembly may comprise the cover part which comprises a recess having a shape complementary to at least part of the insert part.

The closing assembly may comprise a recess which locks the insert part with respect to the cover part.

The closing assembly may comprise the locking which may be made by mechanical coupling a protrusion of the insert part in a complementary shaped cavity of the recess in the cover part.

The closing assembly may comprise the insert part which may be mounted to the cover part by gluing.

The closing assembly may comprise the insert part which may be slidably mounted in the cover part.

The closing assembly may comprise the recess which may be arranged at an outer edge of the cover part.

The closing assembly may comprise the insert part which is manufactured by molding.

The closing assembly may comprise may comprise the closing assembly may comprise a part of the insert part which has a curved shape.

The closing assembly may comprise the insert part which may have a top part surrounding the opening and a lower part, the top part having a first area size and the lower part having a second area size, the first area size being smaller than the second area size, wherein when the insert part is received in the recess, the top part is flush with the cover part.

According to an aspect of the disclosure a hearing aid comprising the closing assembly according to the disclosure is provided.

According to an aspect of the disclosure a behind the ear hearing aid comprising the closing assembly according to the disclosure is provided.

Since the recess in the cover and the insert have corresponding shapes, the insert substantially fills the recess and complement the shape of the cover.

The insert is locked in the recess thus forming steady connection of the components of the hearing aid.

This means that the insert may have protrusion around its circumference and the recess in the cover has a cavity having a shape corresponding to the protrusion. This is especially advantageous since the protrusion enters the cavity, which is below surface of the cover, therefore part of the insert which can be seen from the outside is reduced.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
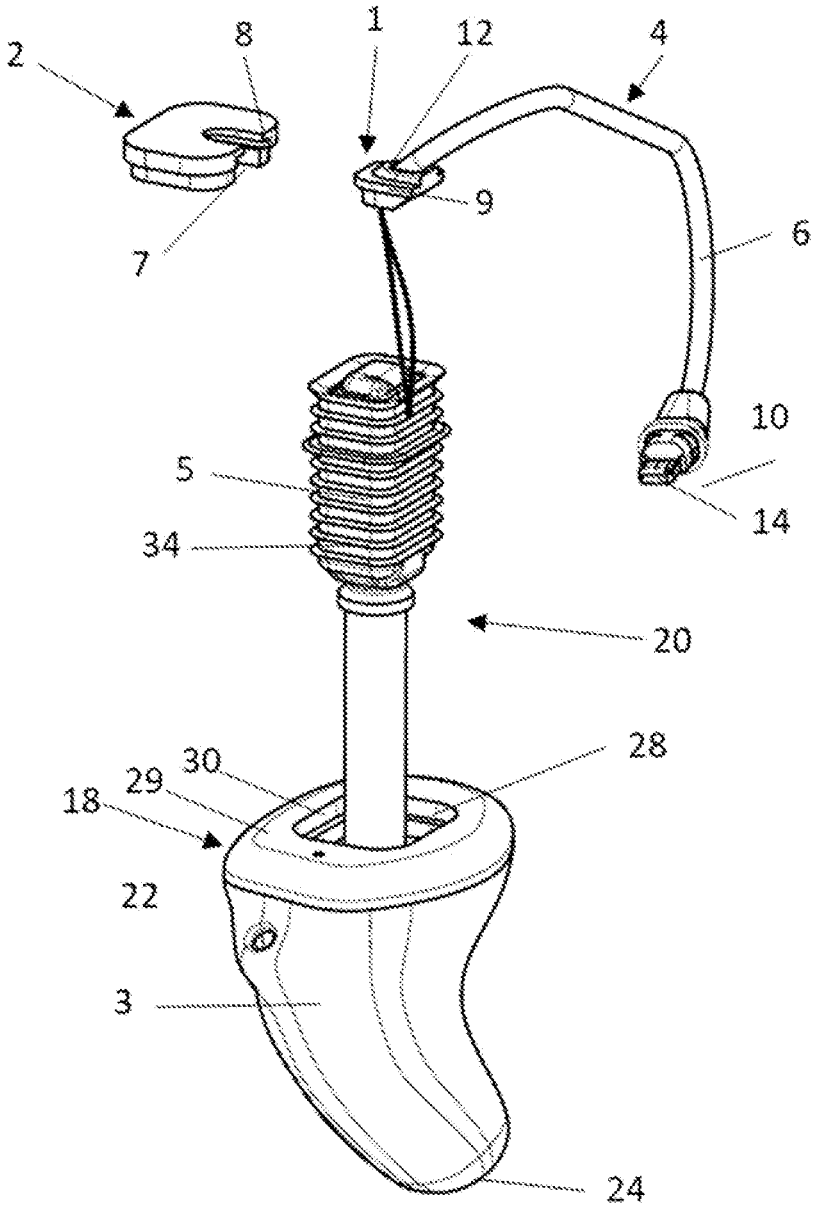
FIG. 1 shows a hearing aid with a closing assembly according to the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include micro-electronic-mechanical systems (MEMS), integrated circuits (e.g. application specific), microprocessors, microcontrollers, digital signal processors (DSPs), field programmable gate arrays (FPGAs), programmable logic devices (PLDs), gated logic, discrete hardware circuits, printed circuit boards (PCB) (e.g. flexible PCBs), and other suitable hardware configured to perform the various functionality described throughout this disclosure, e.g. sensors, e.g. for sensing and/or registering physical properties of the environment, the device, the user, etc. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device (or hearing instrument, hearing assistance device) may be or include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. 'Improving or augmenting the hearing capability of a user' may include compensating for an individual user's specific hearing loss. The "hearing device" may further refer to a device such as a hearable, an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of the middle ear of the user or electric signals transferred directly or indirectly to the cochlear nerve and/or to the auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal and connected by conductive wires (or wirelessly) to the unit behind the ear, such as in a Behind-the-Ear type hearing aid, and/or ii) arranging the hearing device entirely or partly in the pinna and/or in the ear canal of the user such as in an In-the-Ear type hearing aid or In-the-Canal/Completely-in-Canal type hearing aid, or iii) arranging a unit of the hearing device attached to a fixture implanted into the skull bone such as in a Bone Anchored Hearing Aid or a Cochlear Implant, or iv) arranging a unit of the hearing device as an entirely or partly implanted unit such as in a Bone Anchored Hearing Aid or a Cochlear Implant.

FIG. 1 illustrates an exploded view of an in-the-ear part, generally denoted 18, connected to a connecting member 4, having a plug or connector 16. These general components are often referred to as a speaker assembly 20 for a hearing aid. FIG. 1 further shows a closing assembly according to the disclosure in an exploded view.

The closing assembly comprises an insert part or inset part 1 and a cover or cover part 2. The cover part 2 comprises a recess 7. The recess 7 has a form of a cut made in at the outer edge or rim of the cover part 2. The cover part 2 may have a cavity or groove 8 formed along at least part of the recess 7. The insert part 1 may have a protrusion 9 arranged along at least part of a circumference of the insert part 1. The protrusion 9 is configured so that when the insert part 1 is inserted in the cutout or recess 7, the shape of the protrusion 9 corresponds to the shape of the cavity 8. Therefore, the insert part 1 suits or mates with the recess 7. In use, a connecting member 4 is provided, the connecting member 4 is configured to establish a mechanical connection between an in-the-ear part and a behind-the-ear part of a hearing aid. The insert part 1 is configured to be mounted onto an end of the connecting member 4. The insert part 1 with the connecting member 4 in then is fitted into a cover part 2. The insert part 1 has a top part 12 which complements the surface of the cover part 2 when the insert part 1 is placed in the cover part 2. When the insert part 1 is mounted to the cover part 2, the top part 12 is flush with the surface of the cover so that there is no visible transition between the two parts. Further, the top part, seen from above, has a very small size and as such does not contribute to the outer surface of the assembly to be noticeable. The top part 12 may be seen from the outside of the closing assembly. The top part 12 needs to be as narrow as possible in order to reduce visibility of the insert part 1 from the outside.

The connecting member 4 has, at the end opposite the end connected to the insert part 1, a tab-connector 14, configured to mate with a corresponding plug in a behind-the-ear housing of a hearing aid, not illustrated here. The connecting member 4 includes a number of electrical conductors configured to carry signals to and/or between the in-the-ear part and the behind-the-ear part. Such signals include signals for an output transducer 5, here an acoustic transducer referred to as a receiver, to convert in to sound signals to be outputted into the user's ear canal.

An end 6 of the connecting member 4 is mounted to the insert part 1 in an opening 8. The end 6 of the connecting member 4 is fixed in the opening 8. The connecting member is preferably fixedly mounted in the opening 8. The mounting is performed for example by mechanical coupling and/or gluing. As there may be a smaller opening between the end 11 of the connecting member 4 and the insert part 1, a further material may be added to seal the opening so as to protect the interior of the in-the-ear part from e.g. cerumen and/or sweat or other contaminates.

The connecting member 4 comprises two electrically conductive wires for establishing communication from a sound processor in the behind-the-ear part and the output transducer in the in-the-ear part. If the in-the-ear part comprises additional components, such as input transducer, e.g. a so-called ear canal or monitor microphone additional wires may be provided to establish communication between these additional components and the behind-the-ear part. One end 11 of the connecting member 4 is fixed to the insert part 1 and at the other end of the connecting member 4 a connector 10 is attached. The connector 10 is for connecting with behind the ear part of the hearing aid (not shown). The output transducer 5 is provided with a suspension 34 to reduce vibrations to the custom part 3.

Figure 2:
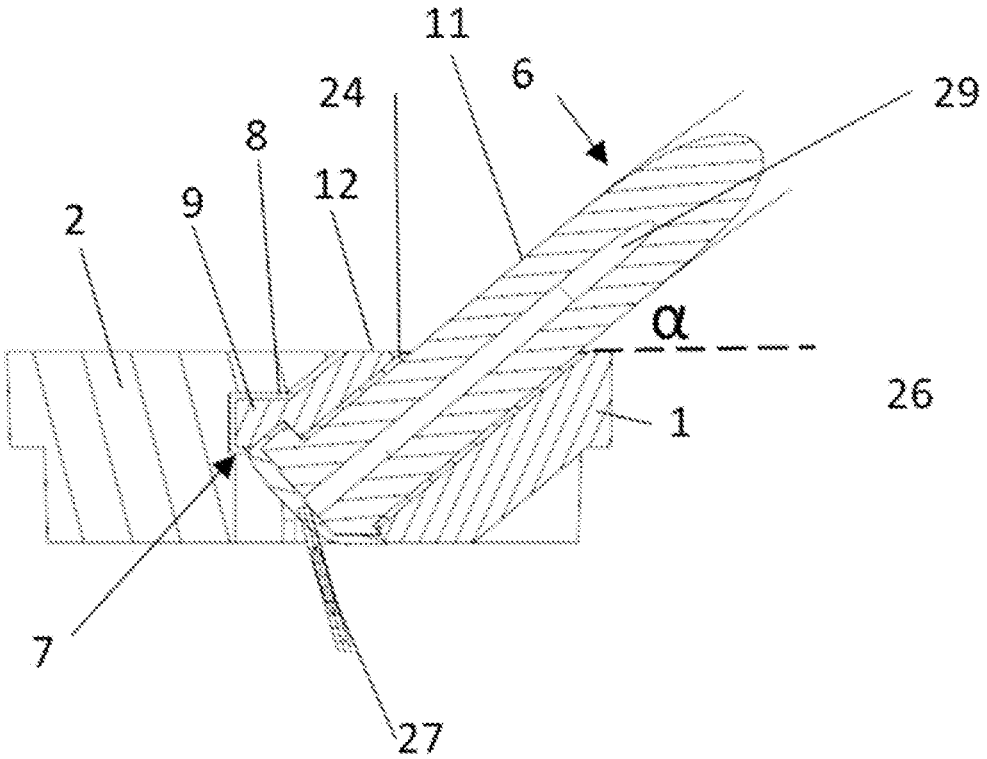
FIG. 2 shows cross-section of the insert.

An opening 26 of the insert part 1 is biased at an acute angle $\alpha$ to a main surface, i.e. the top part 12, of the insert part 1, which can be seen in more detail in FIG. 2. The angle (alpha) is preferably around 45 degrees, and may be around 40 degrees, or around 30 degrees, or around 20 degrees. The angle is preferably less than 80 degrees, such as less than 70 degrees, such as less than 60 degrees, such as less than 50 degrees, such as less than 40 degrees. Other suitable angles or intervals of angles may be envisioned. The top surface 12 of the insert part 1 is a surface which will be parallel to surface of the cover part 2 so that when the two are connected, the top surface 12 is flush with the surface of the cover part 2.

In the connecting member 4, a wire or conductor 29 is received. This wire 29 is used for establishing electrical connection between the output transducer 5 and the behind-the-ear part, where components such as microphones and signal processors are located.

Below the cover part 2, two wires 27 connect to the receiver 5. As the connecting member 4 is fixed relative to the insert part 1, the wire or wires 27 will not move when the user extracts or inserts the in-the-ear part from or into the ear canal. As a result, there is little or no risk of detaching the receiver/output transducer 5 from the electrical connection.

As result of the biased opening 26, the elongated part 6, i.e. the end of the connecting member 4, is directed to desired direction, namely in a direction where behind the ear part of the hearing aid is to be arranged at the area of the top of the pinna so that the housing of the behind-the-ear part is basically hidden by the pinna and thus not too visible when looking at the user's face.

In FIG. 2 the insert part 1 is in position in the recess 7 of the cover part 1. Between the connecting member 4 and insert part 1 a layer of glue is seen. The insert part 1 is provided with a protrusion 9, which engage the cavity 8 formed along the rim of the recess 7. As may be seen in the figure, the protrusion 9 defines an area which compared to an area in a parallel plan of the top part 12 is larger. The size of the top part 12 which will be visible should be as small as possible. The smallness of the top part 12 is advantageous as the cover could be colored according to the skin tone of the user so that the overall impression of the in-the-ear part will be as inconspicuous as possible. As the top part 12 is as small as possible, it is not needed to produce this part in the same color as the cover part 2. The insert part 1 may thus be produced in just a single color, thereby making production more simple. As will be explained, the cover and the mold could be produced by 3D printing and the material chosen may have a color as close a match as possible to the skin tone of the user.

Figure 3A:
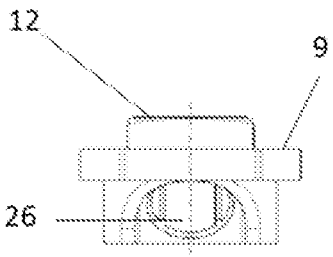
FIG. 3*a*-3*d* shows enlarged view of the inset according to the disclosure.
Figure 3B:
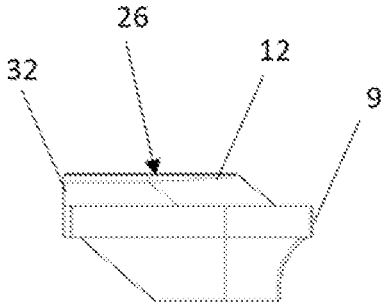
Figure 3C:
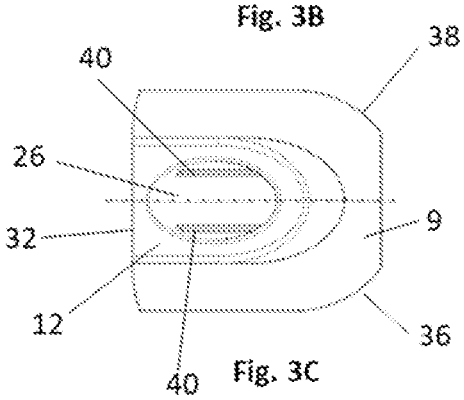

The part of the insert part 1 which enters the cover 2 preferably have curved corners 36, 38 as shown in FIG. 3*c*. The part of the insert part 1 which enters the cover part 2 may have different shape, for example may be entirely curved, oval or tapered. The in-the-ear part shown in FIG. 1 further comprises a receiver 5 arranged or stored in a mold 3. The mold 3 is preferably a custom mold shaped to match an ear canal of the specific user. The cover part 2 and insert part 1 assembly is mounted in an outer face part 28 of the mold 3. The outer surface part 28 will, in use, reside at the ear canal opening of the user. The outer surface part 28 is attached to, or integral with, the mold 3. In the outer face part 28 an opening 30 is configured to receive the cover/insert assembly. The mold 3, outer face part 28 and the cover part 2 are manufactured in the same color, e.g. using the same material. This further allows choosing a color that best match the skin tone of that user. During assembly, the insert part 1 is inserted to the cover part 2, and the cover part 2 closes or seals the mold 3 after the received 5 is placed in the mold 3. At the tip 24 of the mold 3, an outlet provides acoustic sounds from the receiver 4 to the ear canal of the user when the in-the-ear part is mounted/worn by the user. The insert part 1 will lie at or bear against a wall 30 of the in-the-ear part, and the cover part 2 will fit into the remainder of the opening 28.

The in-the-ear part, i.e. the mold 3, further comprises a vent canal 22. This canal ensures or at least alleviates pressure built-up in the ear canal when the mold 3 is inserted into the ear canal of the user. Further, when removing the mold 3 from the ear canal, the vent canal helps prevent or at least alleviates the potentially uncomfortable feeling.

Figure 3D:
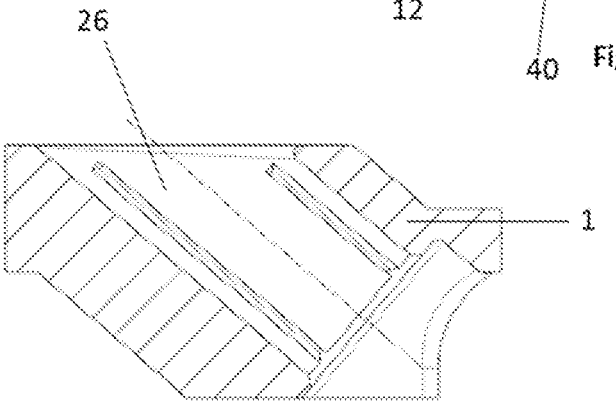

In FIGS. 3A-D different views of the insert part 1 is illustrated. The three top views are back (FIG. 3A), side (FIG. 3B) and front view (FIG. 3C) and a cut-through view (FIG. 3D). The opening 26 is formed so that when the end of a connecting member 4 is inserted in the insert part 1 and the insert part 1 is mounted in the cover part 2, the connecting member 4 is tilted relative to the surface of the cover part 2. The opening 26 may comprise protrusions 40 to engage with the exterior surface of the connecting member 4 in order to fixate the connecting member in the insert part 1.

Also seen in these figures, the protrusion 9 extends beyond the top part 12, and thus defines a larger area compared to the top part 12. In this context it is considered that the area is defined in the plane view upon in FIG. 3C, i.e. the top view. Here the outline of the top part is about half of the area defined by the protrusion 9. When mounted, the wall 32 of the insert part 1 will be next to, or in contact with, a wall of the in-the-ear part opening 28.

Figure 4:
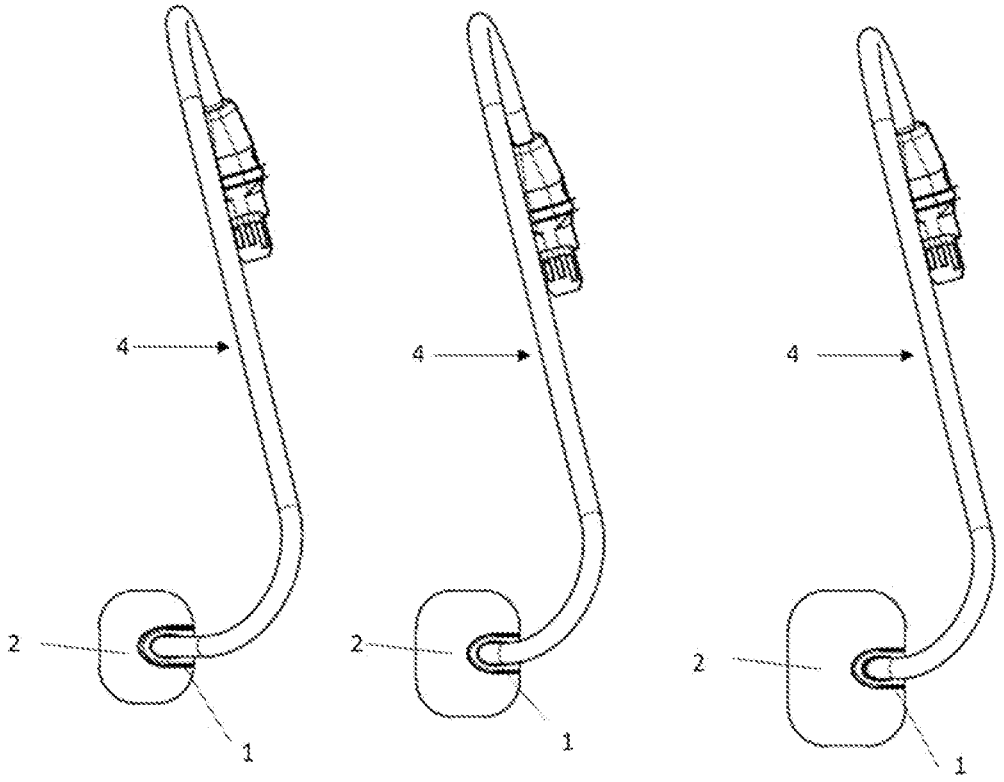
FIG. 4 shows a closing assembly with connecting member in different sizes.

In these views of FIG. 3, it is seen that the top part 12 of the insert part 1 defines an area, or outer geometry that is smaller than the outer geometry defined by the lower, base part FIG. 4 illustrates three differently sized covers 1 each configured to close an opening in an in-the-ear part for receiving a correspondingly sized receiver. As mentioned, a larger receiver/output transducer is required for a higher sound output level. The closing assembly according to the disclosure is thus a universal part which may be used with different sized covers as shown in detail in FIG. 4. FIG. 4 shows the closing assembly according to the disclosure with covers of different size.

LIST OF REFERENCE

1 insert part
2 cover part
3 mold
4 connecting member
5 output transducer or receiver
6 elongated part
7 recess or cutout
8 cavity or groove
9 protrusion
10 connector
11 end of elongated part
12 top part
14 tab connector
18 in-the-ear part
20 speaker assembly
22 vent canal
24 tip
25 glue
26 opening of insert part/biased opening
27 wire
28 in-the-ear part opening
29 conductor
30 wall of in-the-ear part opening
34 suspension
36, 38 round corner
40 protrusion

The invention claimed is:

1. Closing assembly for an in the ear part of a hearing device, the in-the-ear part having a cavity for holding an output transducer, the in-the-ear part having an opening and the closing assembly being configured to fit into the opening, the closing assembly comprising:

an insert part having an inset part opening for receiving and mounting a connecting member, the connecting member configured for mechanically coupling the in the ear part to a behind the ear part of the hearing device, and a cover part comprising a recess for receiving and mounting the insert part, wherein the insert part has a top part surrounding the opening and a lower part, the top part having a first area size and the lower part having a second area size, the first area size being smaller than the second area size, wherein when the insert part is received in the recess, the top part is flush with the cover part.

2. The closing assembly according to claim 1, wherein the insert part opening is configured so that the connecting member enters to the insert part at an acute angle defined between the axis of an end part of a connecting member and a surface of the cover part.

3. The closing assembly according to claim 1, wherein the cover part is configured for the in the ear part which is a mold, shaped to an individual ear canal of the user.

4. The closing assembly according to claim 1, wherein the cover part comprises a recess having a shape complementary to at least part of the insert part.

5. The closing assembly according to claim 1, wherein locking is made by mechanical coupling a protrusion of the insert part in a complementary shaped cavity of the recess in the cover part.

6. The closing assembly according to claim 1, wherein the insert part is mounted to the cover part by gluing.

7. The closing assembly according to claim 1, wherein insert part is slidably mounted in the cover part.

8. The closing assembly according to claim 1, wherein the insert part is manufactured by molding.

9. Hearing aid comprising the closing assembly according to claim 1.

10. Hearing aid according to claim 9 wherein the hearing aid is BTE.

11. The closing assembly according to claim 2, wherein the cover part is configured for the in the ear part which is a mold, shaped to an individual ear canal of the user.

12. Closing assembly for an in the ear part of a hearing device, the in-the-ear part having a cavity for holding an output transducer, the in-the-ear part having an opening and the closing assembly being configured to fit into the opening, the closing assembly comprising:

an insert part having an inset part opening for receiving and mounting a connecting member, the connecting member configured for mechanically coupling the in the ear part to a behind the ear part of the hearing device, and a cover part with a face, the cover part comprising a recess for receiving and mounting the insert part, wherein the cover part locks the insert part with respect to the cover part in a direction transverse to the face of the cover part, by means of a protrusion of the insert part and a complementary shaped cavity in the recess.

13. The closing assembly according to claim 12, wherein insert part has a protrusion around at least a portion of its circumference and wherein the recess in the cover part has a cavity for accommodating the protrusion, whereby the protrusion is accommodated in the cavity below the face of the cover part.

14. The closing assembly according to claim 12, wherein the insert part opening is configured so that the connecting member enters to the insert part at an acute angle defined between the axis of an end part of a connecting member and a surface of the cover part.

15. The closing assembly according to claim 12, wherein the insert part has a top part surrounding the opening and a lower part, the top part having a first area size and the lower part having a second area size, the first area size being smaller than the second area size, wherein when the insert part is received in the recess, the top part is flush with the cover part.

16. Hearing aid comprising the closing assembly according to claim 12.

17. Hearing aid according to claim 16 wherein the hearing aid is BTE.

18. Closing assembly for an in the ear part of a hearing device, the in-the-ear part having a cavity for holding an output transducer, the in-the-ear part having an opening and the closing assembly being configured to fit into the opening, the closing assembly comprising:

an insert part having an inset part opening for receiving and mounting a connecting member, the connecting member configured for mechanically coupling the in the ear part to a behind the ear part of the hearing device, and a cover part with a face, the cover part comprising a recess for receiving and mounting the insert part the insert part, wherein a protrusion and a complementary shaped cavity locks the insert part, received in the recess, with respect to the cover part in a direction transverse to the face of the cover part, wherein the connecting member accommodates at least two electrically conductive wires which extend through the insert part, and wherein the connecting member terminates in the insert part.

19. The closing assembly according to claim 18, wherein the wires which extend through the insert part terminates at an output transducer in a suspension member.

20. The closing assembly according to claim 18, wherein insert part has a protrusion around at least a portion of its circumference and wherein the recess in the cover part has a cavity for accommodating the protrusion, whereby the protrusion is accommodated in the cavity below the face of the cover part.

21. The closing assembly according to claim 18, wherein the insert part opening is configured so that the connecting member enters to the insert part at an acute angle defined between the axis of an end part of a connecting member and a surface of the cover part.

22. The closing assembly according to claim 18, wherein the insert part has a top part surrounding the opening and a lower part, the top part having a first area size and the lower part having a second area size, the first area size being smaller than the second area size, wherein when the insert part is received in the recess, the top part is flush with the cover part.

23. Hearing aid comprising the closing assembly according to claim 18.

24. Hearing aid according to claim 23 wherein the hearing aid is BTE.

* * * * *